US005394938A

United States Patent [19]

Cornette et al.

[11] Patent Number: 5,394,938

[45] Date of Patent: Mar. 7, 1995

[54] GRAVEL PACK SCREEN FOR WELL COMPLETIONS

[75] Inventors: Holley M. Cornette; Robert K. Bethel, both of Houston; Elmer R. Peterson, Woodlands, all of Tex.

[73] Assignee: Atlantic Richfield Company, Los Angeles, Calif.

[21] Appl. No.: 922,717

[22] Filed: Jul. 31, 1992

[51] Int. Cl.[6] ..... E21B 43/08

[52] U.S. Cl. ..... 166/51; 166/74; 166/205

[58] Field of Search ..... 166/51, 74, 205, 229, 166/278, 231, 233, 325; 175/392, 394

[56] References Cited

U.S. PATENT DOCUMENTS

| | | | |
|---|---|---|---|
| 166,048 | 7/1875 | Whipple | 166/205 |
| 395,034 | 12/1888 | Coffin | 166/205 |
| 1,080,684 | 12/1913 | Erickson | 166/74 |
| 2,341,237 | 2/1944 | Phipps | 175/394 |
| 2,371,391 | 3/1945 | Haynes | 166/51 |
| 2,513,944 | 7/1950 | Kessler | 166/205 |
| 3,583,487 | 6/1971 | Block | 166/51 |
| 4,635,725 | 1/1987 | Burroughs | 160/278 |
| 5,036,920 | 8/1991 | Cornette et al. | 166/51 |
| 5,062,484 | 11/1991 | Schroeder, Jr. et al. | 166/205 X |

*Primary Examiner*—Ramon S. Britts
*Assistant Examiner*—Frank S. Tsay
*Attorney, Agent, or Firm*—Drude Faulconer

[57] ABSTRACT

A gravel pack well tool comprised of a workstring having a gravel pack screen thereon wherein the workstring can be rotated without applying any substantial torque to the screen jacket which forms part of the gravel pack screen. This allows the workstring to be rotated in either direction during installation or removal of the gravel pack screen without damaging the screen jacket. The gravel pack screen is comprised of a fluid-permeable base pipe having a screen jacket rotatably mounted thereon.

15 Claims, 1 Drawing Sheet

GRAVEL PACK SCREEN FOR WELL COMPLETIONS

DESCRIPTION

1. Technical Field

The present invention relates to gravel pack screen for use in well completions and in one of its preferred aspects relates to a gravel pack screen adapted to be rotated into a column of pre-placed gravel by a workstring wherein the screen is comprised of a base pipe having a screen jacket rotatably mounted thereon whereby said workstring and base pipe can be rotated without applying torque to the screen jacket.

2. Background Art

In wells which produce fluids from incompetent subterranean formations (i.e. formations formed of an unconsolidated matrix such as loose sandstone or the like) or from formations which have been hydraulically-fractured and propped, it is not uncommon for large volumes of particulate material, e.g. sand, to dislodge from the formation and be produced with the formation fluids. These produced particulate materials are highly detrimental to the operation of the well and cause erosion, plugging, etc. of the well equipment which, in turn, leads to high maintenance costs and considerable downtime of the well. Accordingly, sand control methods are routinely employed in these producing wells.

One of the best known of these sand control methods is one which is commonly referred to as "gravel packing"; see PETROLEUM PRODUCTION ENGINEERING, Oil Field Development, L. C. Uren, Third Edition, McGraw-Hill Book Co., N.Y., 1946, pps. 575–588. Basically, a typical gravel pack completion is comprised of a fluid-permeable liner which is positioned in the wellbore adjacent the producing formation and an aggregate or particulate material (collectively called "gravel") which fills the annulus between the liner and the casing or the wall of the wellbore. The gravel particles are sized to block or filter out the formation particulates from the produced fluids while the openings in the liner are sized to block the both gravel and the particulate material from flowing into the liner with the fluids.

A variety of fluid-permeable liners are available for used in gravel pack completions. One of the more widely-used of these is commonly referred to as a "gravel pack screen" or a "screened pipe". A typical, early gravel pack screen was comprised of a perforated base pipe having wire wrapped around and fixed thereto. The wire was coiled around the outer periphery of the pipe in the form of a spiral which, in turn, had a prescribed space between the coils depending on the size of the gravel to be used in forming the gravel pack. While these screens offered little resistance to fluid flow, they were structurally weak and susceptible to damage in handling. For example, the wire coils were likely to be displaced during insertion of the screen into the well, especially if the wellbore was crooked. Further, it was difficult to remove the screened pipe from a well after it had been positioned without destroying the wire wrapping.

More recent gravel pack screens have been developed which overcome many of the problems encountered by the earlier screens. In these gravel pack screens, the screen is no longer formed by wrapping the wire directly onto the base pipe but instead, is formed by first coiling the wire into a separate "screen jacket" which, in turn, is subsequently positioned and welded onto the perforated base pipe. The screen jacket has a plurality of longitudinally-extending rods which are positioned against the inside surface of the coiled wire and are welded at each point a rod contacts the wire. These rods prevent (1) the spirals of wire from separating when the gravel pack screen is pulled from a well and (2) "bird-nesting" of the jacket if the screen has to be milled in the well. Also, the rods provide a "standoff" between the jacket and the base pipe when assembled. This type of gravel pack screens is well known and is commercially-available; e.g. "BAKERWELD" Gravel Pack Screens, Baker Sand Control, Houston, Tex.

While gravel pack screens such as described above work well in most gravel pack completions, they may experience problems when used in those gravel pack completions wherein the gravel is pre-placed in the wellbore and the liner is then rotated as it is lowered into the gravel; see U.S. Pat. 2,371,391; 2,513,944; and 5,037,920. The screen jacket being affixed to the base pipe which, in turn, is coupled into the workstring, may be subjected to substantial torques when the workstring, hence the base pipe, is rotated during installation of the screen. This torque can cause severe damage to the screen jacket.

Further, and equally as important, if the gravel pack screen becomes stuck in the well during either installation or removal of the gravel pack screen, it may be necessary to reverse the rotation of the gravel pack screen as an upward force is applied throught the workstring to free the stuck screen. If the screen jacket becomes stuck and cannot rotate and since the screen jacket is fixed to the base pipe, any rotation of the workstring will likely cause severe damage to the screen jacket.

DISCLOSURE OF THE INVENTION

The present invention provides a gravel pack well tool comprised of a workstring having a gravel pack screen thereon wherein the workstring can be rotated without applying any substantial torque to the screen jacket which forms part of the gravel pack screen. This allows the workstring to be rotated in either direction during installation or removal of the gravel pack screen without damaging the screen jacket, thereby allowing the gravel pack screen to be used in well completions wherein the gravel is first placed in the wellbore and then the gravel pack screen is augered or otherwise rotated into the pre-placed gravel.

More specifically, the present gravel pack well tool is comprised of a workstring having an auger-liner assembly connected to the lower end thereof. Auger-liner assembly is comprised of a "gravel pack screen" which is comprised of a fluid-permeable base pipe having a screen jacket rotatably mounted thereon. The base pipe is adapted to be connected at one end to the workstring and to a nose sub or the like at its other end.

The screen jacket is formed by coiling a length of wrap wire into a spiral which has a desired width between each of the individual coils based on the desired size of flow passages through the screen. A plurality of rods are radially-spaced around and against the interior surface of the coil and extend longitudinally throughout it length. Each rod is welded to the wrap wire at each point it contacts the wire to form an integral and stable screen jacket. The upper and lower ends of the coiled wire are fixed to terminals which have a sliding seal thereon so that when the screen jacket is positioned onto base pipe, the seals will prevent longitudinal flow between screen jacket and the base pipe.

The screen jacket is slipped onto base pipe but is not attached or affixed to the pipe so that jacket is free to rotate with respect to base pipe. The jacket is held against longitudinal movement on the base pipe upper and lower collars which are to secured to base pipe. In one embodiment, a fluid-permeable, torque sleeve is positioned over the screen jacket and is secured to collars. The diameter of the torque sleeve is greater than the outside diameter of the screen jacket so that the screen jacket can rotate with respect to both the torque sleeve and the base pipe. An auger blade extends around and is affixed to the external surface of torque sleeve whereby the gravel pack screen can be augered into place.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
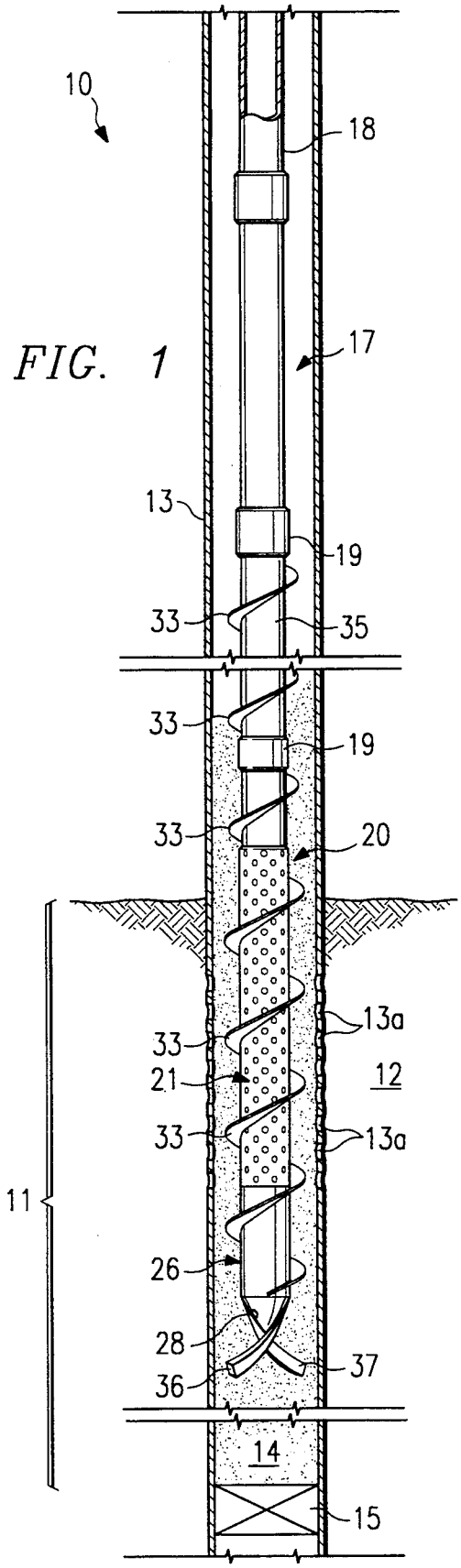
FIG. 1 is an elevational view, partly in section, of a gravel pack completion in which the present invention can be used

Referring more particularly to the drawings, FIG. 1 illustrates a gravel pack completion being installed in well 10 (e.g. production or injection well). Well 10 has a completion zone 11 therein which lies adjacent to a relatively incompetent formation 12 of the type which is likely to produce sand and/or other particulate material at some time during its operational life. As shown, well 10 has been cased along its length with casing 13 which has been perforated to provide perforations 13*a* adjacent zone 11. While FIG. 1 illustrates completing a zone in a cased, vertical wellbore, it should be understood that the this type of completion can also be carrying out in open holes as well as in horizontal or deviated wells.

In those wells where the wellbore extends past the bottom of completion zone 11, a cement plug, bridge plug or an equivalent-type packer 15 may be set in the wellbore at the lower end of zone 11. Sufficient gravel 14 then supplied down the wellbore and onto the top of plug 15 to fill the wellbore through the length of zone 11 which is to be completed. "Gravel" as used herein includes all particulate and/or aggregate materials (e.g. gravel, sand, combinations, etc. ) which are used or can be used in gravel pack or fractured completions. As known in the art, the "gravel" particles used in a particular situation are sized so as to block or filter out the particulates or props which may be produced with the well fluids.

The pre-placed gravel 14 may be introduced into wellbore in any suitable manner, depending upon the actual circumstances involved with a particular completion zone 11. For example, where formation 12 is a relatively low pressured formation, gravel may be flowed down and out of the lower end of a workstring (not shown) or it may be dumped or pumped or bull-headed into the well at the surface and allowed to fall under the influence of gravity. The gravel may be flowed into the wellbore as a substantially dry mixture or as a slurry (mixed with a carrier fluid such as polymer-type, water-based fluid, crude oil, etc.). After the gravel 14 is in place adjacent to zone 11, gravel pack well tool 17 is lowered into the wellbore.

As illustrated, gravel pack well tool 17 is comprised of an auger-liner assembly 20 which is connected onto the bottom of workstring 18. Auger-liner assembly 20 is comprised of a gravel pack screen having an auger blade 33 extending along its outer periphery. Auger blade 33 has basically the same configuration as known earth augers in that it has one or more continuous flightings which extend helically around the periphery of assembly 20 and is secured thereto by any appropriate means, e.g. welding. The auger blade 33 extends sufficiently along the length of gravel pack tool 17 to insure that the auger-liner assembly 20 can be properly positioned at a depth within the preplaced gravel 14 to form the desired gravel pack completion. If auger-liner assembly 20 is comprised of segments and blanks or if blank tubular sections 35 (one shown in FIG. 1) above auger-screen 20 are also to be positioned within gravel 14, auger blade 33 may also extend about the periphery of such blanks.

Affixed to the lower end of gravel pack screen 21 is nose sub 26 which, in turn, has two, diametrically-opposed, spirally-extending blades 36, 37 mounted thereon which effectively form a "fish-tail" bit 28 at the leading edge of sub 26. Blades 36, 37 may be independent elements which are welded or otherwised secured to the sub 26 or if dual flights are used to form auger blade 33, then blades 36, 37, respectively, may be the terminals or these flights.

To carry out the gravel-pack completion shown in FIG. 1, gravel 14 is placed adjacent completion zone 11 as described above and well tool 17 is lowered on workstring 18 until it contacts the top of the gravel 14. Workstring 18 is then rotated at the surface by a rotary table, power sub, or the like (none shown) to rotate auger-screen 20 and "auger" it downward-into pre-placed gravel 14. Fish-tail bit 28 allows the tool to easily penetrate the gravel and auger blade 33 mechanically moves the displaced gravel upward as the auger-screen is moved downward into place. Again, for a more complete description of such a completion, see U.S. Pat. No 5,036,920.

Figure 2:
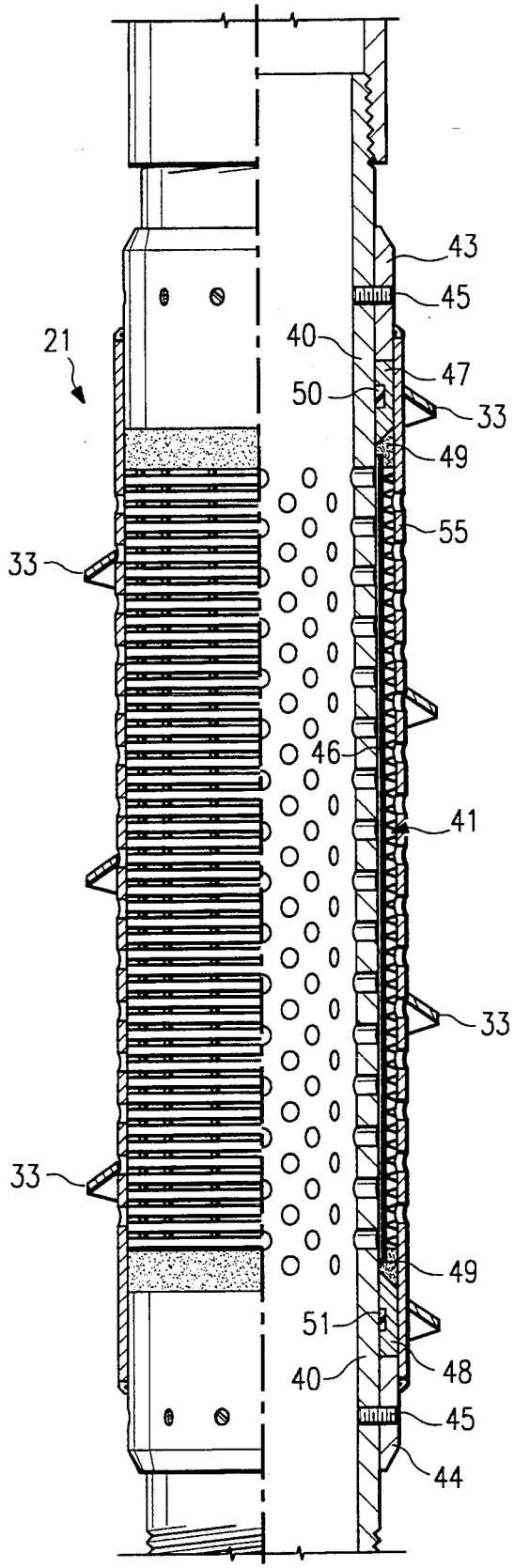
FIG. 2 is an enlarged view, partly in section, of the gravel pack screen in accordance with the present invention.

Referring now to FIG. 2, the gravel pack screen 21 of the present invention is adapted to be connected at one end to workstring 18 to nose sub 26 at its other end. It will be understood that more than one length of gravel pack screen is to be used, they may be coupled directly to each other or by blanks depending on the actual gravel pack completion being carried out. Gravel pack screen 21 is comprised of a fluid-permeable base pipe 40, i.e. perforated pipe, having a screen jacket 41 rotatably mounted thereon.

As illustrated, screen jacket 41 is formed by coiling a length of wrap wire into spiral which has a desired width between each of the individual coils of wire depending on the desired size of the flow passages through the screen (i.e. related to the size of the gravel 14 (FIG. 1) to be used in a particular gravel pack completion). A plurality of rods 46 (only one shown in FIG. 2) are radially-spaced around and against the interior surface of the screen jacket and extend longitudinally throughout its length. Each rod is welded to the wrap wire at each point the rod contacts the wire thereby forming an integral and highly stable screen jacket. Preferably, the wrap wire is cut in a keystone shape, which allows a self-cleaning action for greater flow and less chance of clogging. It should be recognized that the actual manner in which the screen is constructed may vary within the scope of the present invention.

The upper and lower ends of the coiled wire are fixed to rings or terminals 47, 48, respectively, by welds 49 or the like. Each of these terminals have an annular groove on its inner surface to receive a sliding seal 50, 51, respectively, so that when screen jacket 41 is positioned onto base pipe 40, seals 50, 51 will prevent longitudinal flow between screen jacket and the base pipe. Screen jacket 41 is slipped onto base pipe 40 but is not attached or affixed to the pipe so that it will be free to rotate with respect to base pipe 40. Rods 46 on the interior surface of the jacket provide a stand-off for the jacket which prevents the wire from contacting the base pipe and thereby substantially reduce the friction between the base pipe and the screen jacket. The jacket is held against longitudinal movement on pipe 40 by upper and lower collars 43, 44, respectively, which, in turn, are to secured to base pipe 40 by welding, set screws 45, and/or other appropriate means.

Where gravel pack screen 21 is used in a "auger-liner" completion as illustrated, a fluid-permeable, torque sleeve 55, (i.e. perforated sleeve having openings 56 therethrough) is positioned over screen jacket 41 and is secured in place by welding or otherwise affixing the ends of sleeve 55 to collars 43, 44, respectively. The diameter of sleeve 55 is greater than the outside diameter of sleeve jacket 41 so that the jacket can rotate with respect to both base pipe and sleeve 55. Auger blade 33 extends around and is affixed to the external surface of torque sleeve 55.

It can be seen that screen jacket 41 will not be subjected to any substantial torques as workstring 18 (FIG. 1) is rotated to lower gravel pack liner 21 into gravel 14. Also, if the liner 21 becomes stuck while gravel pack screen 21 is being lowered or can not easily be removed from gravel 14 when required, workstring can be rotated in a reverse direction, again without applying any substantial torque on screen jacket 41. The rotational torque applied by workstring 18 is transmitted through base pipe 40 and torque sleeve 55 but not through screen jacket 41 since the screen jacket is free to rotate on base pipe 40.

While the present invention has been described in relation to an auger-liner, gravel pack completion, it should be recognized that an embodiment thereon could be used in other completions. For example, where a liner may need to be rotated during installation of removal in a gravel pack completion which does not require an auger, perforated sleeve 55 and auger blade 33 can be elimated. Screen jacket 41 would still be rotatably mounted on base pipe 40 but still would not be subjected to any substantial torque when base pipe 40 rotated.

What is claimed is:

1. A gravel pack screen for use in well completions, said screen comprising:

a fluid-permeable base pipe; and a screen jacket rotatably mounted on said base pipe.

2. The gravel pack screen of claim 1 including;

a fluid-permeable, torque sleeve positioned over said screen jacket and affixed to said base pipe; and an auger blade affixed along the external surface of said torque sleeve.

3. The gravel pack screen of claim 1 wherein said fluid-permeable base pipe comprises;

a perforated pipe; and wherein said screen jacket comprises:

wire formed in a spiral wherein the individual coils of wire forming the spiral are spaced from each other by a prescribed distance to thereby provide flow passages through said screen jacket.

4. The gravel pack screen of claim 3 including:

a respective terminal affixed to each end of said wire forming said spiral, each terminal having a sliding seal which cooperates with said base pipe to prevent longitudinal flow between said screen jacket and said base pipe.

5. The gravel pack screen of claim 1 including: an upper and lower collar affixed to said base pipe above and below said screen jacket, respectively, to fix said screen jacket against longitudinal movement on said base pipe.

6. The gravel pack screen of claim 5 including:

a fluid permeable, torque sleeve affixed to said upper and lower collars; and an auger blade affixed to the external surface of said torque sleeve.

7. A gravel pack well tool comprising:

a workstring; and an auger-liner assembly connected at one end to said workstring, said auger-liner assembly comprising:

a fluid-permeable liner comprising:

a fluid-permeable base pipe; and a screen jacket rotatably mounted on said base pipe;

a nose sub affixed to the lower end of said fluid permeable liner; and an auger blade secured to and extending along said fluid-permeable liner and said nose sub.

8. The gravel pack well tool of claim 7 including:

a fluid-permeable, torque sleeve positioned over said screen jacket and affixed to said base pipe; and said auger blade being affixed along the external surface of said torque sleeve.

9. The gravel well tool of claim 7 wherein said fluid-permeable base pipe comprises:

a perforated pipe; and wherein said screen jacket comprises:

wire formed in a spiral wherein the individual coils of wire forming the spiral are spaced from each other by a prescribed distance to thereby provide flow passages through said screen jacket.

10. The gravel pack well tool of claim 9 including:

a respective terminal affixed to each end of said wire forming said spiral, each terminal having a sliding seal which cooperates with said base pipe to prevent longitudinal flow between said screen jacket and said base pipe.

11. The gravel pack well tool of claim 7 including:

an upper and lower collar affixed to said base pipe above and below said screen jacket, respectively, to fix said screen jacket against longitudinal movement on said base pipe.

12. The gravel pack well tool of claim 11 including:

a fluid permeable, torque sleeve affixed to said upper and lower collars; and said auger blade being affixed to the external surface of said torque sleeve.

13. The gravel pack well tool of claim 7 including:

a bit affixed on said leading edge of said nose sub.

14. The gravel pack well tool of claim 13 wherein said bit comprises:

a fish-tail bit.

15. The gravel pack well tool of claim 14 including:

a blank tubular section in said workstring above said auger-liner assembly; and wherein said auger blade extends along and is affixed to said blank section.

* * * * *